United States Patent [19]

Simeth et al.

[11] Patent Number: 4,781,791

[45] Date of Patent: Nov. 1, 1988

[54] PROCESS FOR PRODUCING STRUCTURED RETAINING AREAS ON SHEET GRIPPERS AND SHEET GRIPPER SUPPORTS FOR SHEET HANDLING MACHINES

[75] Inventors: Claus Simeth; Werner Sondergeld, both of Offenbach am Main, Fed. Rep. of Germany

[73] Assignee: M.A.N.-Roland Druckmaschinen Aktiengesellschaft, Offenbach am Main, Fed. Rep. of Germany

[21] Appl. No.: 55,607

[22] Filed: May 28, 1987

[30] Foreign Application Priority Data

May 31, 1986 [DE] Fed. Rep. of Germany ..... 3618444

[51] Int. Cl.[4] ..... B44C 1/22; C23F 1/02

[52] U.S. Cl. ..... 156/659.1; 101/412; 156/645; 156/654; 156/664; 156/905

[58] Field of Search ..... 156/640, 645, 654, 656, 156/659.1, 664, 905; 101/408–412; 427/309, 383.5, 383.7

[56] References Cited

U.S. PATENT DOCUMENTS

| | | | |
|---|---|---|---|
| 2,870,560 | 1/1959 | Kauschka | 156/659.1 X |
| 2,933,040 | 4/1960 | Helmig | 101/412 |
| 2,972,300 | 2/1961 | Mitchell | 101/412 |
| 4,032,378 | 6/1977 | McDonald et al. | 156/659.1 X |
| 4,264,410 | 4/1981 | Frantzen | 156/654 X |

*Primary Examiner*—William A. Powell

*Attorney, Agent, or Firm*—Leydig, Voit & Mayer

[57] ABSTRACT

The invention relates to a process for the production of structured retaining areas on sheet grippers, sheet gripper supports or similar gripper facilities for machines for handling and processing sheets by the formation of a non-etchable dot structure on the base member and the subsequent etching out of intervening areas. To provide structured retaining areas having a smoothly shaped surface, the dot structure is produced by screen printing or pressure pad printing and after the etching-out of unprinted areas, a hard smoothing coating, preferably of chromium or ceramic, is applied to the structural retaining area.

8 Claims, 1 Drawing Sheet

PROCESS FOR PRODUCING STRUCTURED RETAINING AREAS ON SHEET GRIPPERS AND SHEET GRIPPER SUPPORTS FOR SHEET HANDLING MACHINES

FIELD OF THE INVENTION

The present invention relates to a process for producing structured retaining areas on sheet grippers, sheet gripper supports or similar gripper facilities for machines for handling and processing sheets.

BACKGROUND OF THE INVENTION

The print quality which can be provided by printing machines, more particularly multi-color rotary presses, depends largely upon the ability of the consecutive gripper systems to retain the sheet reliably—i.e., to prevent the sheet from slipping—and to ensure that the original sheet register position is retained while the sheet is passing through the press. The use of art papers and viscous inks imposes stringent requirements on the means which ensure that the register is maintained. The retaining forces can be increased, but not ad infinitum, or the adhesion of the gripper means can be enhanced by surface patterning.

It is known from U.S. Pat. No. 2,933,040 for the sheet to be engaged not by the entire gripper area, but by discrete dots or tips produced by the formation of a non-etchable dot structure on the base member of a gripper support made of a hardened material and subsequent etching-out of unmasked surfaces with an acid.

A disadvantage in the foregoing disclosure is that the dot structure is produced photochemically—i.e., by etching operations in association with previous photographic operations. The resulting structure is relatively dense, containing approximately 300–400 dots per square centimeter. A surface of this kind cannot provide a satisfactory positive engagement. Also, there is a risk that the resulting fissured hooking structure may clog up rapidly with paper dust. Consequently, although a large number of paper-supporting tips or dots are provided, the effectiveness thereof when they are pressed on to the paper stock surface is considerably impaired, with the result of reduced retaining forces between the sheet gripper and the associated sheet gripper support.

OBJECTS AND SUMMARY OF THE INVENTION

It is the primary object of the present invention to provide a process of the kind hereinbefore set out in order to produce structured retaining areas on sheet gripper members comprised of a plurality of dot structures with each dot having a smoothly shaped surface.

In accordance with the present invention, a process is provided for the formation of a nonetchable dot structure on a hard base member, preferably of hardened steel, and subsequent etching-out of unmasked areas with acid or alkaline etching agents, wherein the dot structure is produced by screen printing or pressure pad printing and after the etching-out of unprinted areas a hard smoothing coating of chromium or ceramic material is applied to the structured retaining area. Preferably, the dot structure covers less than 10% of the base area and each dot has a profile diameter of approximately 0.03 mm. These and other features and advantages of the invention will be more readily apparent upon reading the following description of a preferred exemplified embodiment of the invention and upon reference to the accompanying drawings wherein:

DESCRIPTION OF A PREFERRED EMBODIMENT

Figure 1:
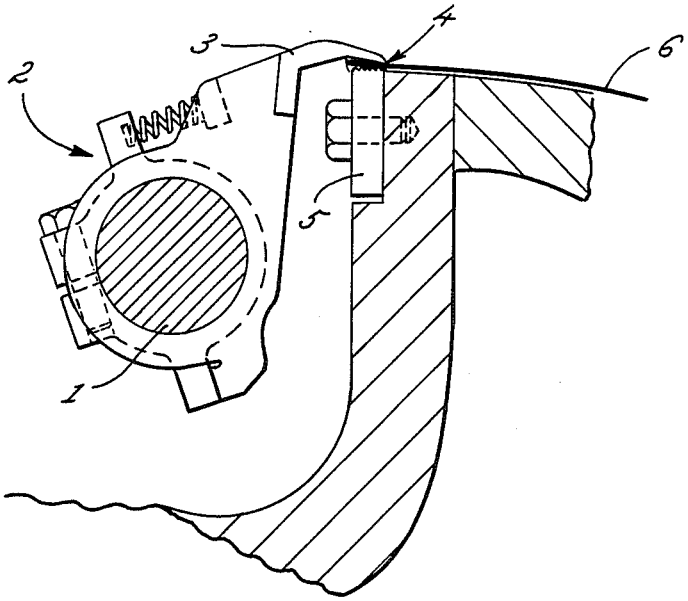
FIG. 1 is a fragmentary side elevation, partly in section, of a sheet gripper facility.

Turning now to the drawings, FIG. 1 shows a sheet-gripping facility for engaging and conveying sheets 6. A sheet gripper 2 is secured to a gripper shaft 1 and preferably has an interchangeable gripper finger 3 having a hard retaining area 4 structured in accordance with the invention. A sheet gripper support 5 which also has a hard retaining area 4 structured in accordance with the invention is disposed opposite the finger 3. If desired, one of the surfaces 4 can be made of a smooth hard or resilient substance such as a plastic material. Typically, a number of fingers 3 and supports 5 are arranged together in a clamping device and the sheet 6 is disposed between the fingers 3 and supports 5. The remainder of the construction of the sheet gripper facility is known and will not be described further.

In accordance with one aspect of the invention, a printing screen 15 is provided for printing a plurality of dots 10 on the gripper surfaces 4.

Figure 2:
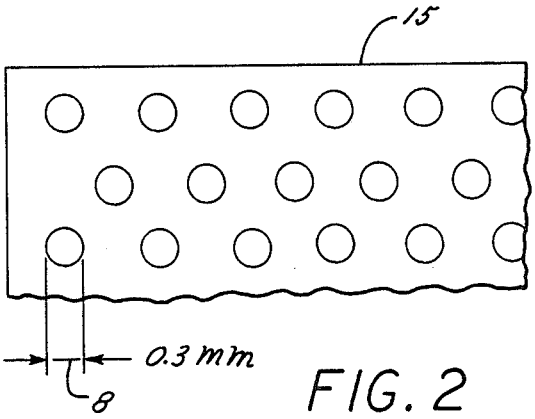
FIG. 2 is a plan view to an enlarged scale of an embodiment of the screen of a retaining area structured in accordance with the invention.

FIG. 2 is a plan view showing the embodiment of a screen 15 for printing a skewed or diagonal pattern of dots 10 on the retaining areas 4. Alternatively, the screen arrangement can be arranged to print dots 10 to form the retaining lines, embodied by profiles 7, in a right-angled, arcuate or a random pattern. The important consideration is that approximately 100 dot profiles having a profile diameter of 0.3 mm and covering at most 10% of the area are provided per square centimeter of the area 4.

Figure 3:
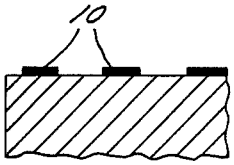
FIGS. 3–5 are diagrammatic views, in side elevation of the profile, showing consecutive steps in the production of the retaining area according to the invention. While the invention will be described and disclosed in connection with certain preferred embodiments and procedures, it is not intended to limit the invention to those specific embodiments. Rather it is intended to cover all such alternative embodiments and modifications as fall within the spirit and scope of the invention.
Figure 4:
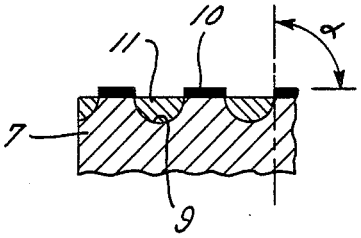
Figure 5:
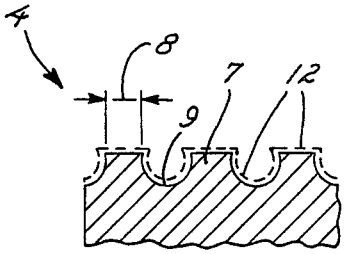

FIGS. 3 to 5 are diagrammatic views, in each case in a side elevation of the dot structure profile, to show the production of the areas 4 according to the invention in three consecutive steps. Profiles 7 are disposed on the area 4 with an angle $\alpha$ of approximately 90° at the profile crest or tip 8, with a smooth flank and with a relatively open radial and relieved profile base 9.

Pursuant to the present invention, the area 4 is produced by means of the following steps:

1. Pretreatment, for example, by grinding and subsequent degreasing, of those surfaces of the fingers 3 and/or support 5 which will subsequently form the areas 4;

2. Printing of the dot structure according to the invention of the base member by means of a modified screen printing process. Frameless metal screens, for example, of nickel electroplated on sheet metal, or a comparable plastics fabric and the printing-on of non-etchable paint or of a corresponding ink as non-etchable material have proved very suitable. FIG. 3 is a diagrammatic side elevation showing printed-on paint or ink dots 10. Instead of the modified screen printing process, for example, pad pressure printing can be used.

3. Etching out of the uncoated areas 11 between the dots 10 (see FIG. 4) with known acid or alkaline etching agents adapted to the base substance. This treatment can be in the form, for example, of $FeC1_3$ being sprayed on at approximately 60° C. for approximately 20 minutes. To facilitate removal of the prepared material the etching agent can be sprayed on. Rinsing with water is then performed, possibly in association with brushes to improve the cleaning of the complete surface;

4. Coating of the dot structure with a smooth hard coating 12, preferably of chromium, for example, by galvanic deposition in known manner. Instead of the chromium treatment, a coating treatment with other smooth hard layers, for example, fine ceramic layers (see FIG. 5), can be given. The advantages of the process are that the flanks of etched-out dots can be formed in the etching-out of the unmasked areas safely—i.e., without fissuring—with a reduced roughness. The surface texture according to the invention finally arises in association with the concluding smoothing treatment of this kind of etched-out area, for example, by hard chromium plating, and the resulting structure has a shaping but not cutting effect on the sheet. Clogging of the structure with paper fibers is also inhibited. The profile also has an increased working life. The structure is resistant to attacking cleaning agents and has a long working Accordingly, the invention ensures a continuous reliable engagement of sheets 6 and non-damaging further conveyance thereof independently of resilient properties of the sheet 6 or of resilient properties of the retaining area pairing selected. As possible pairings, one of the following may be selected.

1. A structured gripper finger made of a hard base material opposite a structured sheet gripper support made of a hard base material, suitable particularly for printing board;

2. A structured gripper finger of a hard material opposite a smooth sheet gripper support made of a hard material or the converse, more particularly suitable for thin papers;

3. A structured gripper finger made of a hard material opposite a resilient sheet gripper support area or the converse.

We claim as our invention:

1. A process for the production of structured retaining areas on sheet grippers, sheet gripper supports and similar gripper facilities for machines for handling and processing sheets by the formation of a non-etchable dot structure on a hard base member, preferably of hardened steel, and subsequent etching-out of unmasked areas with acid or alkaline etching agents, characterized in that the dot structure is produced by screen printing and after the etching-out of unprinted areas a hard smoothing coating is applied to the structured retaining area.

2. A process according to claim 1, characterized in that the dot structure is produced by pad pressure printing.

3. A process according to claim 1, characterized in that the dot structure covers less than 10% of the base area and each dot has a profile diameter of approximately 0.3 mm.

4. A process according to claim 2, characterized in that the dot structure covers less than 10% of the base area and each dot has a profile diameter of approximately 0.3 mm.

5. A process according to claim 3, characterized in that the hard smooth coating is a chromium material.

6. A process according to claim 3, characterized in that the hard smooth coating is a ceramic material.

7. A process according to claim 4, characterized in that the hard smooth coating is a chromium material.

8. A process according to claim 4, characterized in that the hard smooth coating is a ceramic material.

* * * * *